US008539791B2

(12) United States Patent
Hariu et al.

(10) Patent No.: US 8,539,791 B2
(45) Date of Patent: Sep. 24, 2013

(54) MANUFACTURING METHOD OF TRANSITION CRITICAL REFRIGERATING CYCLE DEVICE

(75) Inventors: Satoshi Hariu, Gunma-ken (JP); Jun Sato, Ota (JP); Hiroshi Tamayama, Ashikaga (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 970 days.

(21) Appl. No.: 11/727,708

(22) Filed: Mar. 28, 2007

(65) Prior Publication Data

US 2007/0227182 A1 Oct. 4, 2007

(30) Foreign Application Priority Data

Mar. 28, 2006 (JP) ..... 2006-87820

(51) Int. Cl.
*F25B 41/00* (2006.01)
*F25B 1/10* (2006.01)

(52) U.S. Cl.
USPC ..... 62/510; 62/196.1

(58) Field of Classification Search
USPC ..... 62/510, 196.2, 196.1, 196.3
See application file for complete search history.

(56) References Cited

U.S. PATENT DOCUMENTS 3,064,449 A * 11/1962 Rigney ..... 62/470
3,181,141 A * 4/1965 Villiers ..... 342/46
3,869,874 A * 3/1975 Ditzler ..... 62/278
3,885,938 A * 5/1975 Ordonez ..... 62/196.2
4,593,757 A * 6/1986 McClintock ..... 165/162
4,901,791 A * 2/1990 Kadle ..... 165/150
5,520,891 A * 5/1996 Lee ..... 422/200
5,915,469 A * 6/1999 Abramzon et al. ..... 165/134.1
6,253,567 B1 * 7/2001 Imanari et al. ..... 62/434

(Continued)

FOREIGN PATENT DOCUMENTS

JP 2004-317073 11/2004
JP 2005-188924 7/2005
WO WO 2006/009790 A2 1/2006

OTHER PUBLICATIONS

Oxford University, Oxford English Dictionary [online]. Draft revision of Mar. 2010. Oxford University Press [retrieved on Nov. 9, 2010]. Retrieved from the Internet:<URL: http://dictionary.oed.com/cgi/entry/00329214?query_type=word&queryword=oblique&first=1&max_to_show=10&sort_type=alpha&search_id=a5S0-bqWKL5-14249&result> Obliquely.*

(Continued)

*Primary Examiner* — Ljiljana Ciric
*Assistant Examiner* — Alexis Cox
(74) *Attorney, Agent, or Firm* — Kratz, Quintos & Hanson, LLP

(57) ABSTRACT

A manufacturing method of a transition critical refrigerating cycle device in which a gas cooler and a sub-cooler are integrated to constitute one heat exchanger so as to most efficiently cool a refrigerant in the device. The transition critical refrigerating cycle device is constituted by successively connecting a compressor, the gas cooler, a capillary tube and an evaporator, and having a supercritical pressure on a high-pressure side of the device. The sub-cooler cools an intermediate-pressure refrigerant of the device. A ratio of the number of refrigerant pipes of the sub-cooler to the number of refrigerant pipes of the whole heat exchanger is set to 20% or more and 30% or less. The refrigerant pipes of the sub-cooler have a uniform heat transfer area per unit length of each refrigerant pipe.

8 Claims, 7 Drawing Sheets

(56) References Cited

U.S. PATENT DOCUMENTS

| | | | | |
|---|---|---|---|---|
| 6,314,748 | B1 * | 11/2001 | Zhu et al. | 62/263 |
| 6,742,582 | B1 * | 6/2004 | Wheat et al. | 165/259 |
| 7,779,642 | B2 * | 8/2010 | Bae et al. | 62/175 |
| 7,921,661 | B2 * | 4/2011 | Taras et al. | 62/228.5 |
| 2003/0177782 | A1 * | 9/2003 | Gopalnarayanan et al. | 62/505 |
| 2004/0216484 | A1 * | 11/2004 | Yamasaki et al. | 62/510 |
| 2005/0274501 | A1 * | 12/2005 | Agee | 165/146 |
| 2006/0107677 | A1 * | 5/2006 | Iguchi et al. | 62/246 |
| 2006/0191288 | A1 * | 8/2006 | Radermacher et al. | 62/510 |
| 2009/0173071 | A1 * | 7/2009 | Kapich | 60/605.2 |
| 2010/0199694 | A1 * | 8/2010 | Taras et al. | 62/117 |

OTHER PUBLICATIONS

Office Action dated Jun. 29, 2010 corresponding to Japanese patent application No. 087820/2006.

* cited by examiner

MANUFACTURING METHOD OF TRANSITION CRITICAL REFRIGERATING CYCLE DEVICE

BACKGROUND OF THE INVENTION

The present invention relates to a manufacturing method of a transition critical refrigerating cycle device having a supercritical pressure on a high-pressure side.

In recent years, considering from a global environment problem, a refrigerating cycle device has been developed in which, for example, carbon dioxide ($CO_2$) is used as a refrigerant (see, e.g., Japanese Patent Application Laid-Open No. 2005-188924). In a case where carbon dioxide is used as the refrigerant, a transition critical cycle is achieved in which a refrigerating cycle on a high-pressure side is supercritical. Therefore, in a device in which a cooling function of en evaporator is used for a purpose of refrigerating, freezing or cooling, the refrigerant needs to be more efficiently cooled with a gas cooler to release more heat.

On the other hand, since such a refrigerating cycle on the high-pressure side has a remarkably high pressure, a second-stage compressor is usually used as a compressor constituting the cycle. Furthermore, to improve a compression efficiency of high-stage compression means of this compressor, in this type of device, a sub-cooler is used which cools the refrigerant before the refrigerant is discharged from low-stage compression means and sucked into the high-stage compression means.

This sub-cooler is usually integrated with the gas cooler to constitute one heat exchanger. In this case, the heat exchanger is constituted of a plurality of refrigerant pipes and a fin for heat exchange through which these pipes pass. End portions of the refrigerant pipes are connected to one another via bend pipes (this bend pipe is integrated with the refrigerant pipe, i.e., the refrigerant pipe is sometimes constituted by bending the pipe) to thereby constitute a meandering refrigerant passage. Moreover, a part of the refrigerant pipes are used in the sub-cooler, and the remaining refrigerant pipes are used in the gas cooler.

On the other hand, the gas cooler and the sub-cooler need to cool the refrigerant as much as possible as described above. Therefore, it is preferable to enlarge the heat exchanger. However, since there is a restriction on a space for an actual device, the number of the refrigerant pipes is limited. Therefore, it is necessary to appropriately set a ratio between the number of the refrigerant pipes for the gas cooler and the number of the refrigerant pipes for the sub-cooler in one heat exchanger. That is, when the gas cooler uses a large number of refrigerant pipes, a cooling capability of the refrigerant of the sub-cooler falls short. Conversely, when the gas cooler uses a small number of refrigerant pipes, less heat is radiated from the refrigerant of the gas cooler, and cooling cannot sufficiently be performed.

SUMMARY OF THE INVENTION

The present invention has been developed to solve such a conventional technical problem, and an object of the present invention is to provide a manufacturing method of a transition critical refrigerating cycle device in which a gas cooler and a sub-cooler constitute one heat exchanger so as to most efficiently cool a refrigerant of these coolers.

A manufacturing method of a first invention is a method of manufacturing a transition critical refrigerating cycle device constituted by successively connecting a compressor, a gas cooler, a throttling device and an evaporator and having a supercritical pressure on a high-pressure side of the device, and the method is characterized by comprising: disposing a sub-cooler which cools an intermediate-pressure refrigerant of the compressor; integrating the gas cooler and the sub-cooler to constitute a heat exchanger; and setting a ratio of the number of refrigerant pipes of the sub-cooler to the number of refrigerant pipes of the whole heat exchanger to 20% or more and 30% or less.

A manufacturing method of a transition critical refrigerating cycle device of a second invention is characterized in that in the above invention, the ratio of the number of the refrigerant pipes of the sub-cooler to the number of the refrigerant pipes of the whole heat exchanger is set to 23% or more and 28% or less.

A manufacturing method of a transition critical refrigerating cycle device of a third invention is characterized in that in the above inventions, the compressor includes low-stage compression means and high-stage compression means, the refrigerant discharged from the low-stage compression means enters the sub-cooler, the refrigerant cooled by this sub-cooler is sucked into the high-stage compression means, and the refrigerant discharged from this high-stage compression means enters the gas cooler.

A manufacturing method of a transition critical refrigerating cycle device of a fourth invention is characterized in that in the above inventions, carbon dioxide is used as the refrigerant.

FIG. 6 plots a graph of an outlet temperature of a sub-cooler measured in a case where the sub-cooler and the gas cooler are integrated to constitute the heat exchanger, the total number of the refrigerant pipes is, for example, 60, 7 to 20 refrigerant pipes of them are used in the sub-cooler, and the remaining refrigerant pipes are used in the gas cooler. As the refrigerant, carbon dioxide is used. As the compressor, a two-stage compression type rotary compressor having the low-stage compression means and the high-stage compression means is used.

As apparent from this drawing, it is found that, when the number of the refrigerant pipes of the sub-cooler is 14 (the ratio of the number of the sub-coolers to the total number is in the vicinity of 23.3%), the temperature rapidly drops, but subsequently the temperature slowly drops. That is, it is found that, in a case where the ratio of the number of the refrigerant pipes of the sub-cooler to the total number of the refrigerant pipes of the heat exchanger is set to a range of 20% to 30%, preferably 23% to 28%, with a less number of refrigerant pipes of the sub-cooler, that is, with an increasing number of refrigerant pipes of the gas cooler, the outlet temperature of the sub-cooler can be lowered as much as possible.

According to the first invention, during the manufacturing of the transition critical refrigerating cycle device constituted by successively connecting the compressor, the gas cooler, the throttling device and the evaporator and having the supercritical pressure on the high-pressure side of the device, the sub-cooler which cools the intermediate-pressure refrigerant of the compressor is disposed. The gas cooler and the sub-cooler are integrated to constitute the heat exchanger. Moreover, the ratio of the number of the refrigerant pipes of the sub-cooler to the number of the refrigerant pipes of the whole heat exchanger is set to 20% or more and 30% or less. In the second invention, the ratio is set to 23% or more and 28% or less. Therefore, while as many refrigerant pipes of the gas cooler as possible are secured and a cooling capability of the refrigerant of the gas cooler is maintained, the cooling capability of the refrigerant of the sub-cooler can be secured as much as possible to realize a efficient cycle operation.

DETAILED DESCRIPTION OF THE PREFERRED EMBODIMENT

An embodiment of the present invention will hereinafter be described in detail with reference to the drawings.

Figure 1:
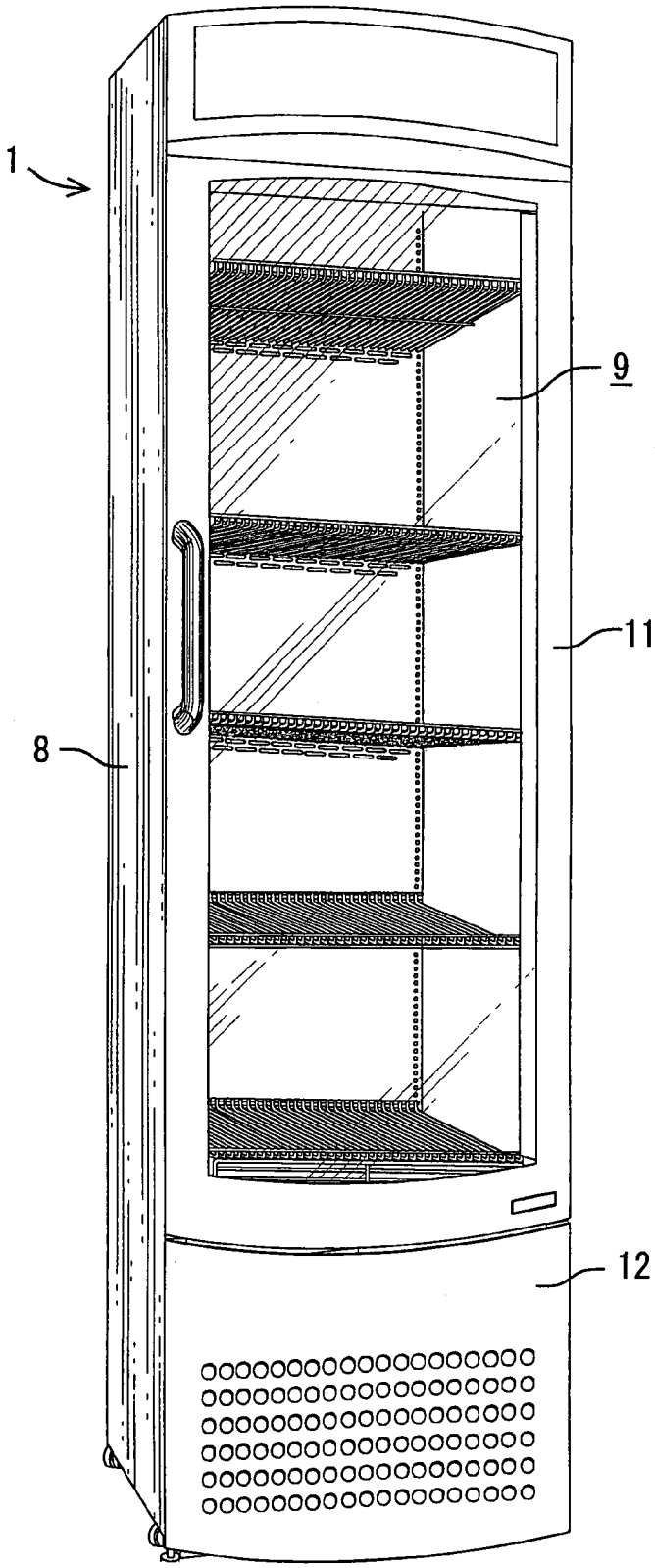
FIG. 1 is a perspective view of a low-temperature showcase according to an embodiment to which the present invention is applied.
Figure 2:
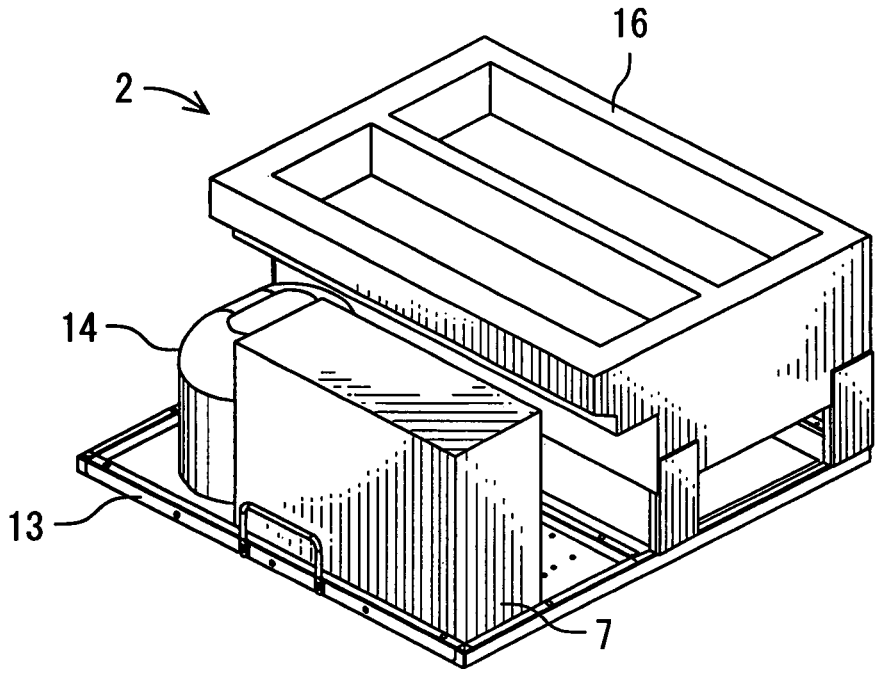
FIG. 2 is a perspective view of a cooling unit of the low-temperature showcase of FIG. 1 according to an embodiment of a transition critical refrigerating cycle device.

In a low-temperature showcase 1 of the embodiment, a main body is constituted of an insulation box member 8 having an open front surface, a showroom 9 is constituted in this insulation box member 8, and the front surface of the insulation box member is openably closed with a transparent door 11. A mechanical chamber 12 is constituted under the insulation box member 8, and a cooling unit 2 of FIG. 2 is stored in this mechanical chamber 12.

Figure 3:
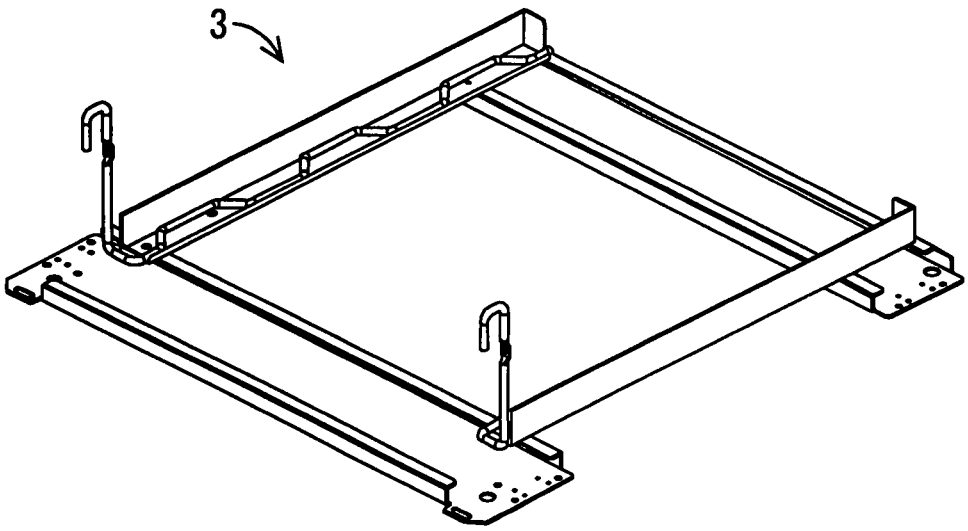
FIG. 3 is a perspective view of a lift mechanism which pushes up the cooling unit of FIG. 2.

The cooling unit 2 is integrally constituted by mounting a compressor 14, a heat exchanger 7 and an insulating cooling box 16 on a base 13, and an evaporator 17 described later and a blower (not shown) are attached in the cooling box 16. Communication holes (not shown) are formed in a bottom wall of the insulation box member 8. This cooling unit 2 is pushed up by a lift mechanism 3 shown in FIG. 3, and the cooling box 16 is pressed onto a lower surface of the bottom wall of the insulation box member 8 so as to connect the cooling box to the showroom 9 via the communication holes. Moreover, cold air subjected to heat exchange between the air and the evaporator 17 is circulated through the showroom 9 by the blower to cool the inside of the showroom at a predetermined (refrigeration) temperature.

Figure 4:
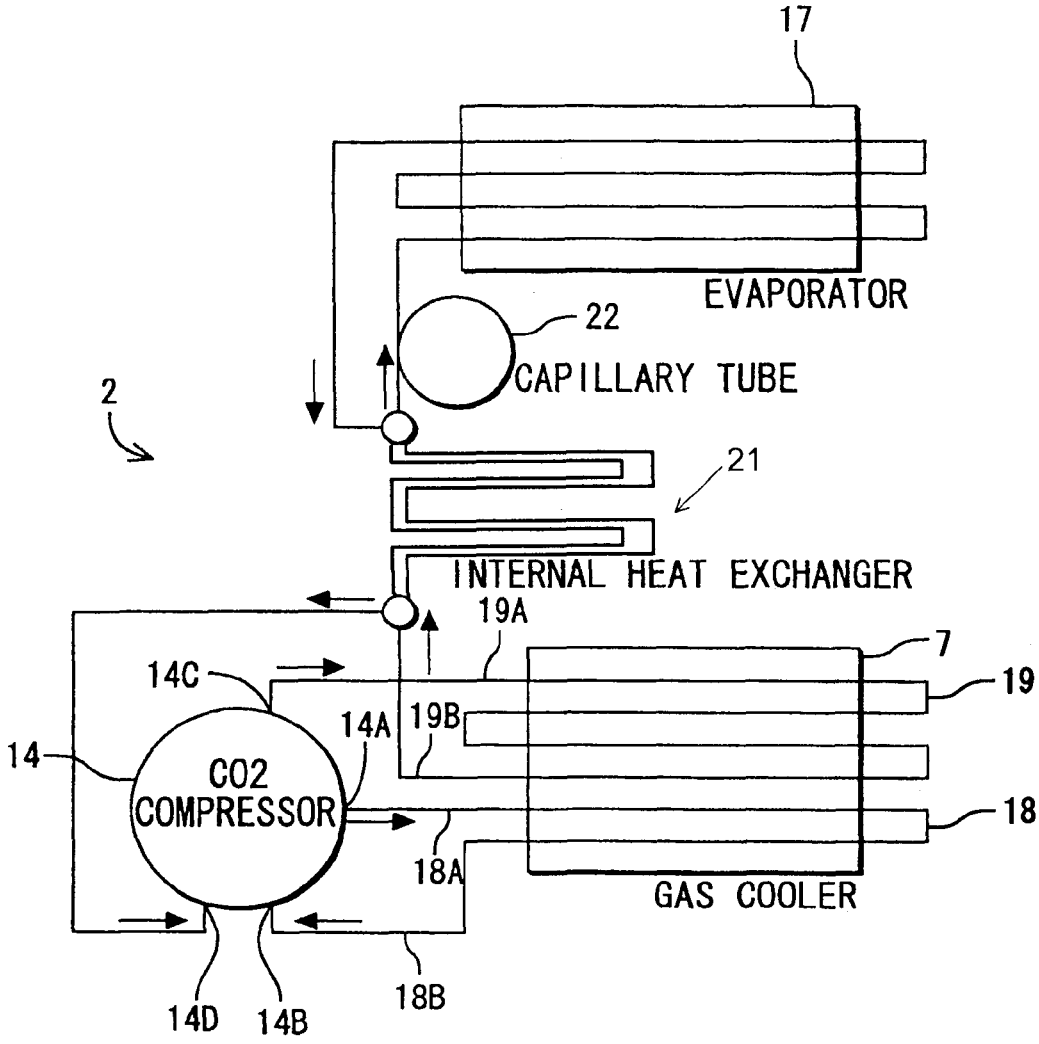
FIG. 4 is a refrigerant circuit diagram of the cooling unit shown in FIG. 2.

Next, in FIG. 4, a predetermined amount of carbon dioxide ($CO_2$) is introduced as a refrigerant into a refrigerant circuit of the cooling unit 2. The compressor 14 is a two-stage (multi-stage) compression type rotary compressor in which low-stage compression means (a rotary compression element of a first stage), high-stage compression means (a rotary compression element of a second stage) and a driving element for driving these means are stored in a sealed vessel. An intermediate discharge port 14A of the compressor 14 is connected to an inlet of a sub-cooler 18, and an outlet of this sub-cooler 18 is connected to an intermediate suction port 14B of the compressor 14.

An intermediate-pressure refrigerant compressed by the low-stage compression means enters the sub-cooler 18 from the intermediate discharge port 14A, is cooled in the sub-cooler, returns from the intermediate suction port 14B to the compressor 14, and is then sucked into the high-stage compression means. The refrigerant compressed at a supercritical pressure (a high pressure) by this high-stage compression means is discharged from a final discharge port 14C to enter a gas cooler 19. The refrigerant is cooled by this gas cooler 19, but the refrigerant still has a gas state at the supercritical pressure. The refrigerant cooled by this gas cooler 19 enters an internal heat exchanger 21, and passes through the exchanger (the supercritical pressure up to here). The pressure of the refrigerant is reduced by a capillary tube 22 as a throttling device. In this process, the refrigerant is brought into a mixed liquid/gas state, and enters the evaporator 17. The liquefied refrigerant evaporates. At this time, the inside of the showroom 9 is cooled by a heat absorbing function.

The refrigerant exiting from the evaporator 17 enters the internal heat exchanger 21 again, is subjected to heat exchange between the refrigerant and a refrigerant from the gas cooler 19 and is cooled. Subsequently, a non-evaporated refrigerant is gasified, and sucked into the low-stage compression means from a suction port 14D (a low pressure) of the compressor 14. This circulation is repeated.

Figure 5:
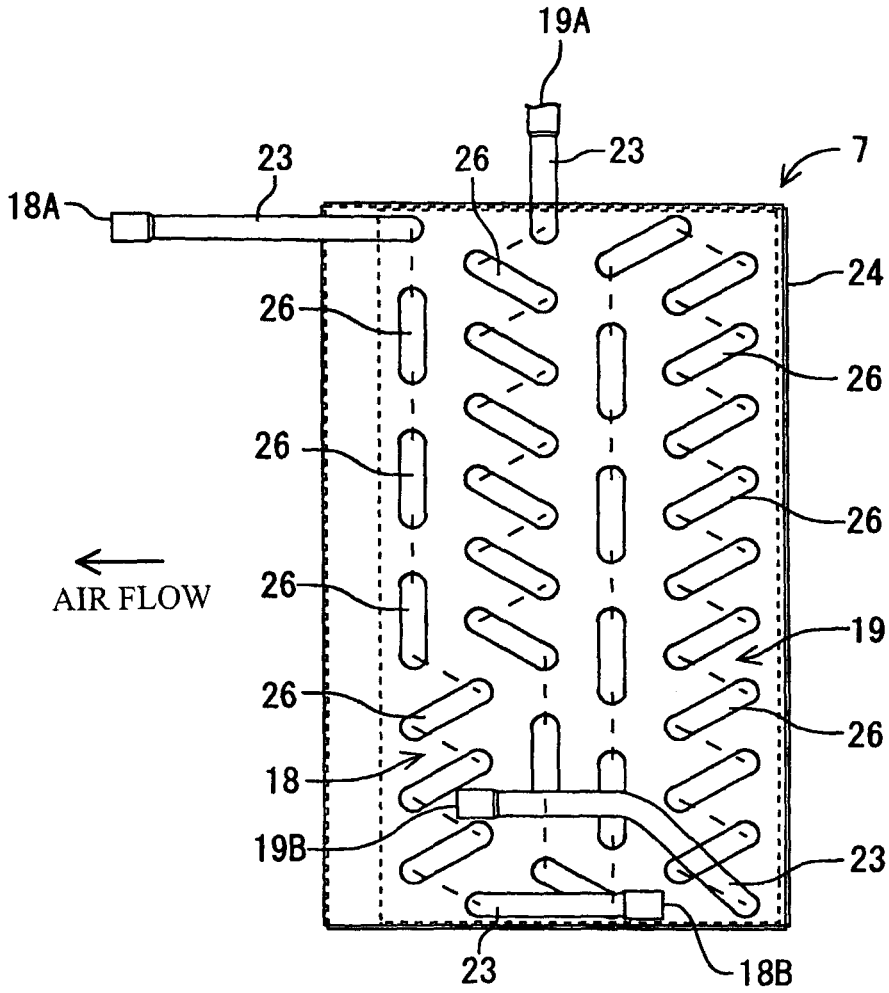
FIG. 5 is a side view of a heat exchanger constituted by integrating a sub-cooler and a gas cooler.

In this case, the sub-cooler 18 and the gas cooler 19 are integrated to constitute the heat exchanger 7. FIG. 5 shows a side view of the heat exchanger 7. In the embodiment, the heat exchanger 7 includes 60 refrigerant pipes 23 extended from left to right, a heat exchange fin through which these pipes pass, and left and right tube plates 24. The heat exchange fin is disposed behind the tube plates 24 and is not shown in FIG. 5. In FIG. 5, shown pipes 26 are bend pipes each of which connects an end portion of a straight tubular refrigerant pipe to that of another straight tubular refrigerant pipe. The bend pipes 26 are connected to the refrigerant pipes 23 to constitute a meandering refrigerant passage.

Moreover, in FIG. 5, the heat exchanger 7 is a so-called fin tube type heat exchanger. In the drawing, reference numeral 18A is an inlet pipe of the sub-cooler 18 disposed in an upper part of the heat exchanger 7 on an air outflow side (the left side as one faces FIG. 5). Reference numeral 18B is an outlet pipe of the sub-cooler 18 disposed in a lower part of the heat exchanger 7 on the air outflow side. Reference numeral 19A is an inlet pipe of the gas cooler 19 disposed in the upper part of the heat exchanger 7 between an air inflow side (the right side as one faces FIG. 5) and the outflow side. Reference numeral 19B is an outlet pipe of the gas cooler 19 disposed in the lower part of the heat exchanger 7 on the air inflow side. That is, the whole gas cooler 19 is disposed on the air inflow side of the heat exchanger 7, and the sub-cooler 18 having a further raised temperature is positioned on the air outflow side of the heat exchanger 7.

Especially, in FIG. 5, the refrigerant pipes are arranged in parallel with one another in a vertical direction on an inlet side of the sub-cooler 18 at the highest temperature (the bend pipes 26 are vertically arranged). The refrigerant pipes are arranged in a zigzag form on a downstream side of the sub-cooler (the bend pipes 26 are obliquely arranged). In consequence, the refrigerant pipes are non-densely arranged on the inlet side at the higher temperature to improve a heat exchange efficiency.

Figure 6:
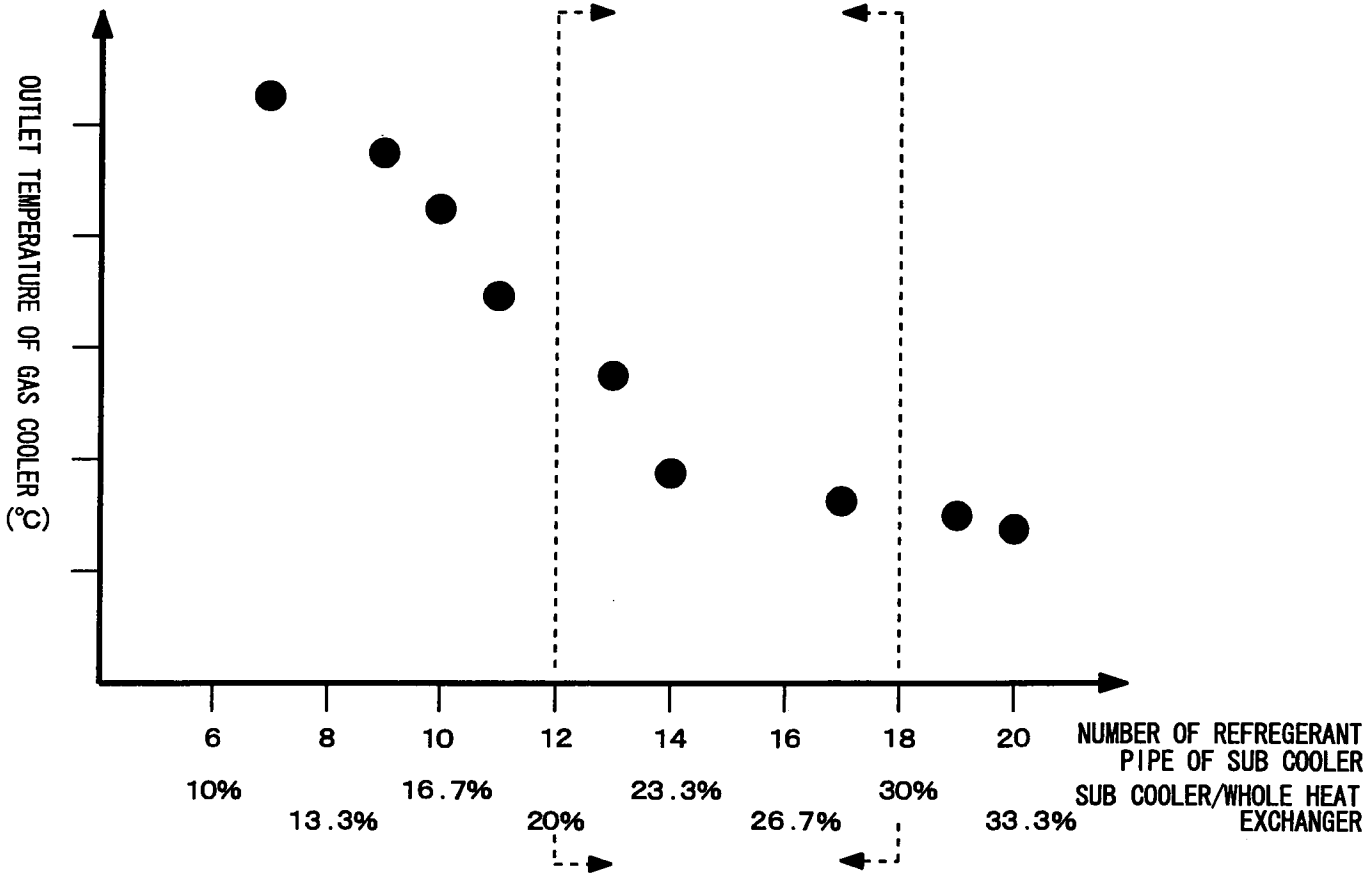
FIG. 6 is a graph showing an outlet temperature of the sub-cooler in a case where the number of refrigerant pipes of the sub-cooler is changed in the heat exchanger of FIG. 5.

Next, results of measurement of an outlet temperature of the sub-cooler 18 in a case where the number of the refrigerant pipes of the sub-cooler 18 is changed are shown in a graph of FIG. 6. The total number of the refrigerant pipes of the sub-cooler 18 and the gas cooler 19 is 60, and data plots outlet temperatures in a case where the sub-cooler 18 includes seven refrigerant pipes and the gas cooler 19 includes the remaining 53 refrigerant pipes; a case where the sub-cooler 18 includes nine refrigerant pipes and the gas cooler 19 includes the remaining 51 refrigerant pipes; a case where the sub-cooler 18 includes ten refrigerant pipes and the gas cooler 19 includes the remaining 50 refrigerant pipes; a case where the sub-cooler 18 includes 11 refrigerant pipes and the gas cooler 19 includes the remaining 49 refrigerant pipes; a case where the sub-cooler 18 includes 13 refrigerant pipes and the gas cooler 19 includes the remaining 47 refrigerant pipes; a case where the sub-cooler 18 includes 14 refrigerant pipes and the gas cooler 19 includes the remaining 46 refrigerant pipes; a case where the sub-cooler 18 includes 17 refrigerant pipes and the gas cooler 19 includes the remaining 43 refrigerant pipes; a case where the sub-cooler 18 includes 19 refrigerant pipes and the gas cooler 19 includes the remaining 41 refrigerant pipes; and a case where the sub-cooler 18 includes 20 refrigerant pipes and the gas cooler 19 includes the remaining 40 refrigerant pipes, respectively.

That is, as the number of the refrigerant pipes 23 of the sub-cooler 18 increases, the outlet temperature drops. However, as apparent from FIG. 6, even when the number exceeds 14, the temperature remarkably slowly drops. That is, it is seen that even when the refrigerant pipes 23 of the sub-cooler 18 are increased in excess of 14, the outlet temperature hardly changes.

To solve the problem, in the present invention, a ratio of the number of the refrigerant pipes 23 of the sub-cooler 18 to the number of the refrigerant pipes 23 of the whole heat exchanger 7 including the gas cooler 19 (the number of the refrigerant pipes of the sub-cooler/the total number (60 refrigerant pipes) of the refrigerant pipes×100) is 20% or more and 30% or less before and after the 14-th refrigerant pipe. Ideally, the ratio is set to a range of 23% to 28% close to the 14-th refrigerant pipe. In the embodiment, the ratio is set to 23.3% corresponding to the 14-th refrigerant pipe. The heat exchanger 7 is manufactured in this manner.

In consequence, while the cooling capability of the refrigerant of the sub-cooler 18 is brought into the maximum capability, the number of the refrigerant pipes 23 of the sub-cooler 18 is reduced as much as possible. Therefore, the maximum number of the refrigerant pipes of the gas cooler 19 is secured, and the cooling capability of the gas cooler 19 can be maintained as long as possible. Especially, a height dimension of the heat exchanger 7 is limited to a size of the heat exchanger to be inserted between the base 13 and the bottom wall of the insulation box member 8 in a case where the heat exchanger is pushed up. While such a limitation is met, the refrigerant cooling capabilities of the sub-cooler 18 and the gas cooler 19 are maximized, and an operation efficiency and a capability of the cooling unit 2 can be improved.

Figure 7:
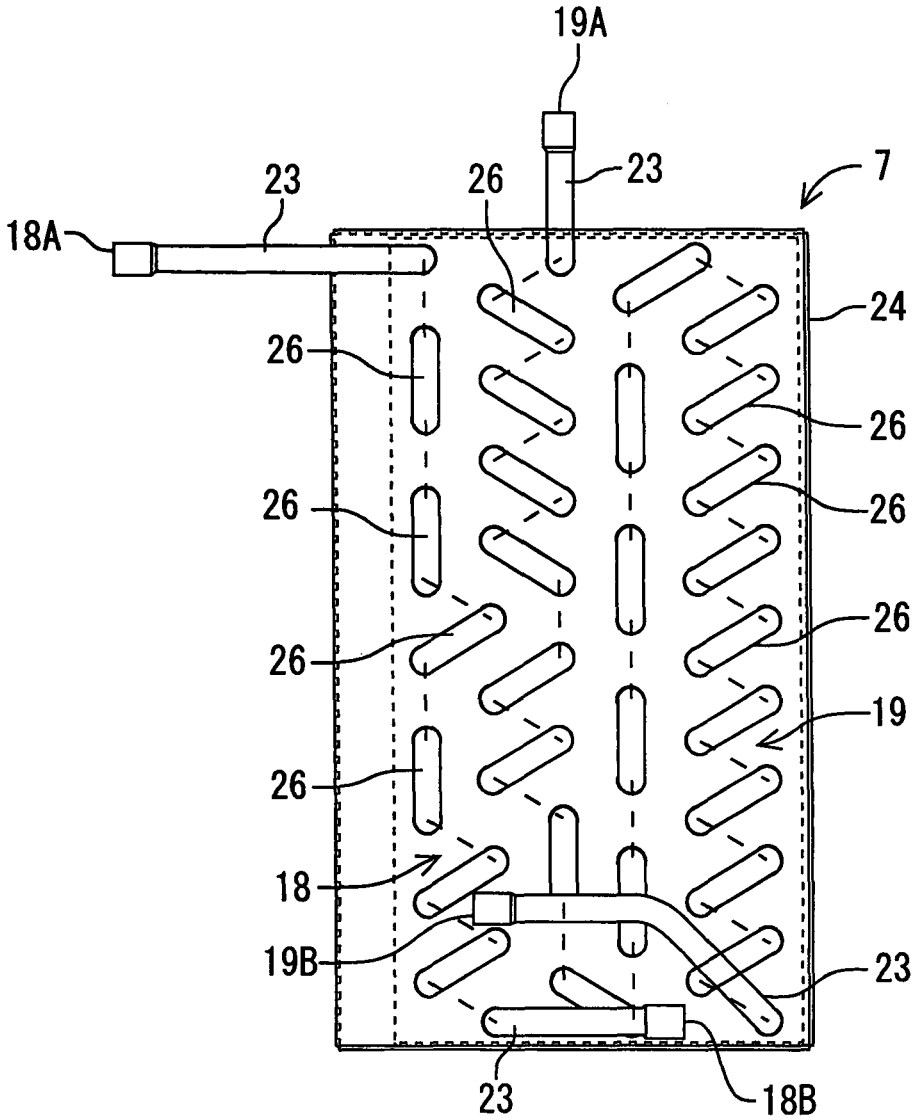
FIG. 7 is a side view of another embodiment of the heat exchanger shown in FIG. 5.
Figure 8:
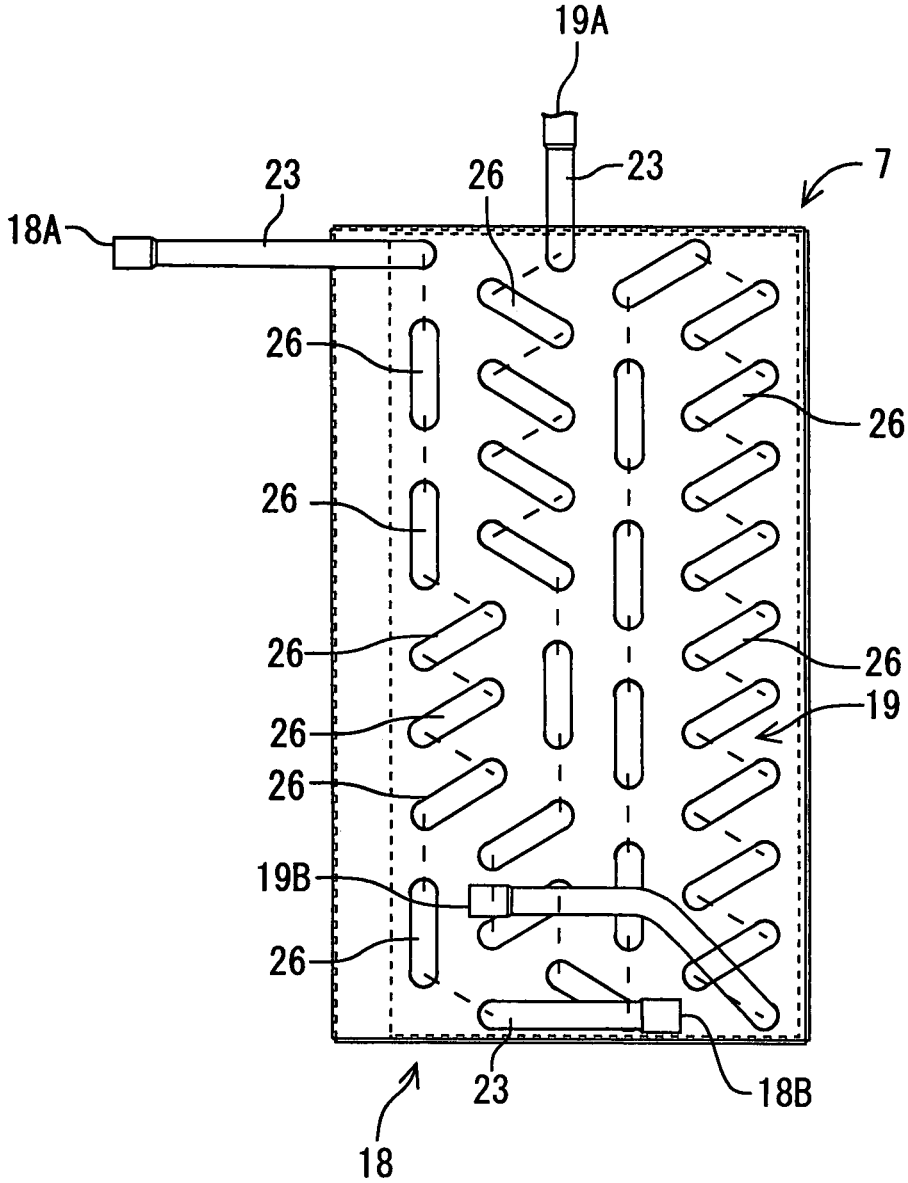
FIG. 8 is a side view of still another embodiment of the heat exchanger shown in FIG. 5.

It is to be noted that in the example of FIG. 5, the refrigerant pipes 23 are non-densely arranged on the inlet side of the sub-cooler 18. The refrigerant pipes on the inlet side may partially densely be arranged as shown in FIG. 7, or a latter half of the refrigerant pipes on the inlet side may densely be arranged as shown in FIG. 8, depending on a dimension of the heat exchanger 7. In addition, the example of FIG. 5 provides the most preferable capability.

What is claimed is:

1. A manufacturing method of a transition critical refrigerating cycle device constituted by successively connecting a compressor, a gas cooler, a throttling device and an evaporator and having a supercritical pressure on a high-pressure side of the device, the method comprising:

providing the gas cooler which cools a high-pressure refrigerant of the compressor by the flow of a refrigerant through refrigerant pipes of the gas cooler and the flow of air as the heat absorber over the refrigerant pipes of the gas cooler;

providing a sub-cooler which cools an intermediate-pressure refrigerant of the compressor by the flow of the refrigerant through refrigerant pipes of the sub-cooler and the flow of air as the heat absorber over the refrigerant pipes of the sub-cooler, wherein the refrigerant pipes of the sub-cooler have a uniform heat transfer area per unit length of each refrigerant pipe;

integrating the gas cooler and the sub-cooler to constitute a heat exchanger;

setting a ratio of the number of refrigerant pipes of the sub-cooler to the number of refrigerant pipes of the whole heat exchanger to 20% or more and 30% or less;

positioning the gas cooler on the air inflow side of the heat exchanger and positioning the sub-cooler on the air outflow side of the heat exchanger;

arranging the refrigerant pipes of the sub-cooler in parallel with one another in a vertical direction on a refrigerant inlet side; and arranging the refrigerant pipes of the sub-cooler obliquely in relation to a vertical direction on a refrigerant downstream side, whereby the refrigerant pipes on the refrigerant inlet side of the sub-cooler are less densely arranged than the refrigerant pipes on the refrigerant downstream side of the sub-cooler.

2. The manufacturing method of the transition critical refrigerating cycle device according to claim 1, wherein the ratio of the number of the refrigerant pipes of the sub-cooler to the number of the refrigerant pipes of the whole heat exchanger is set to 23% or more and 28% or less.

3. The manufacturing method of the transition critical refrigerating cycle device according to claim 2, wherein carbon dioxide is used as the refrigerant.

4. The manufacturing method of the transition critical refrigerating cycle device according to claim 2, wherein the compressor includes low-stage compression means and high-stage compression means;

the refrigerant discharged from the low-stage compression means enters the sub-cooler;

the refrigerant cooled by the sub-cooler is sucked into the high-stage compression means; and the refrigerant discharged from the high-stage compression means enters the gas cooler.

5. The manufacturing method of the transition critical refrigerating cycle device according to claim 4, wherein carbon dioxide is used as the refrigerant.

6. The manufacturing method of the transition critical refrigerating cycle device according to claim 1, wherein the compressor includes low-stage compression means and high-stage compression means;

the refrigerant discharged from the low-stage compression means enters the sub-cooler;

the refrigerant cooled by the sub-cooler is sucked into the high-stage compression means; and the refrigerant discharged from the high-stage compression means enters the gas cooler.

7. The manufacturing method of the transition critical refrigerating cycle device according to claim 6, wherein carbon dioxide is used as the refrigerant.

8. The manufacturing method of the transition critical refrigerating cycle device according to claim 1, wherein carbon dioxide is used as the refrigerant.

* * * * *